US008602815B2

(12) United States Patent
Stockinger et al.

(10) Patent No.: US 8,602,815 B2
(45) Date of Patent: Dec. 10, 2013

(54) SWIMMING POOL DECKPLATE FOR HORIZONTAL SURFACES WITH INTEGRATED SLOPES AROUND ELECTRICAL CONTACTS

(75) Inventors: Christian Stockinger, Loveland, CO (US); Carey Ryerson, Commerce City, CO (US); Brett Anderson, Fort Collins, CO (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 273 days.

(21) Appl. No.: 13/225,654

(22) Filed: Sep. 6, 2011

(65) Prior Publication Data

US 2013/0059465 A1 Mar. 7, 2013

(51) Int. Cl.
*H01R 13/52* (2006.01)

(52) U.S. Cl.
USPC ..... 439/519

(58) Field of Classification Search
USPC ..... 439/519; 200/86 R, 86 A, 512
See application file for complete search history.

(56) References Cited

U.S. PATENT DOCUMENTS

| | | | | | |
|---|---|---|---|---|---|
| 3,522,398 | A * | 7/1970 | Heimann | 200/86 R |
| 3,678,496 | A * | 7/1972 | Stalp | 340/323 R |
| 3,784,768 | A * | 1/1974 | Hunt | 200/52 R |
| 3,944,763 | A * | 3/1976 | Beierwaltes | 200/52 R |
| 4,475,016 | A * | 10/1984 | Berger | 200/52 R |
| 4,700,369 | A * | 10/1987 | Siegal et al. | 377/24.2 |
| 5,291,845 | A * | 3/1994 | Vallery | 114/203 |
| 5,349,569 | A * | 9/1994 | Tanaka | 368/10 |
| 5,549,487 | A * | 8/1996 | Nortier | 439/521 |
| 5,812,049 | A * | 9/1998 | Uzi | 340/323 R |
| 5,837,952 | A * | 11/1998 | Oshiro et al. | 200/86 R |
| 6,054,658 | A * | 4/2000 | Duhon et al. | 200/86 R |
| 6,156,987 | A * | 12/2000 | Warne | 200/512 |
| 6,744,378 | B1 * | 6/2004 | Tyburski | 340/933 |
| 7,029,170 | B2 * | 4/2006 | Bailey | 368/276 |
| 7,119,799 | B2 * | 10/2006 | Kaski | 345/173 |
| 7,372,014 | B1 * | 5/2008 | Stebbins et al. | 250/221 |

* cited by examiner

*Primary Examiner* — Briggitte R Hammond
(74) *Attorney, Agent, or Firm* — McAndrews, Held & Malloy, Ltd.

(57) ABSTRACT

A horizontally mounted connector deckplate for swimming pools to connect swim timing devices and other devices with electrical contacts with potential difference mounted on slopes integrated into the body of the deckplate. These integrated slopes cause corrosive pool water that is splashed on the deckplate, which creates water bridges between electrical contacts, to flow off through gravity, overcoming the water surface tension. Therefore electrolytic currents through the water bridges are greatly reduced, reducing corrosion of the electrical contacts of the deckplate. In addition corrosion resistant materials such as titanium are used for the electrical contacts.

7 Claims, 3 Drawing Sheets

SWIMMING POOL DECKPLATE FOR HORIZONTAL SURFACES WITH INTEGRATED SLOPES AROUND ELECTRICAL CONTACTS

REFERENCES CITED

| | | |
|---|---|---|
| 3,784,768 | January 1974 | Hunt |
| 3,944,763 | March 1976 | Beierwaltes |
| 4,700,369 | October 1987 | Siegal et al. |
| 5,349,569 | September 1994 | Tanaka |
| 5,812,049 | September 1998 | Uzi |
| 6,156,987 | December 2000 | Warne |
| 7,029,170 | April 2006 | Bailey |
| 7,119,799 | October 2006 | Kaski |
| 7,372,014 | May 2008 | Stebbins et al. |

FIELD OF THE INVENTION

The present invention is in the field of connector deck plates with electrical contacts, mounted on essentially horizontal surfaces, in corrosive environments such as swimming pool facilities.

BACKGROUND OF THE INVENTION

When a swimming pool has a timing system installed to measure the swim times of athletes one component of such a system may be connector deck plates on the pool deck. These deck plates are typically situated close to the beginning and end of each lane and present mating connections to connectors of devices such as touchpads, pushbuttons, speakers, relay judging platforms etc. to the central timer unit. Some of these connected devices, for example touchpads, push buttons and relay judging platforms, are used to create timing signals for the timer system to measure the swim times of the athletes. Other connected devices, for example speakers, communicate to the athletes, for example the start signal tone.

In many cases these deckplates are mounted on the pool deck or on a bulkhead. A bulkhead is a moveable device, spanning the pool like a bridge and allowing for partitioning of the pool in variable segments. It can be walked on and it can carry starting blocks.

When deckplates are mounted on the pool deck or a bulkhead, their orientation is essentially horizontal. These horizontally-installed deckplates are the theme of the current invention.

Since these deckplates are adjacent to a swim lane they are typically splashed repeatedly with pool water. Since they present an essentially horizontal plane, that water tends to stay in puddles on the deckplate by virtue of its surface tension.

An essentially horizontal surface in this case is defined as a surface with small angles relative to the horizontal plane, where the water does not flow off from the surface due to surface tension.

Pool water contains aggressive chemicals such as chlorine or bromine. Chlorine, bromine and other chemicals used in swimming pools are corrosive to materials used in electrical connectors such as metals. This corrosion effect is greatly intensified by electrolysis.

When water or corrosive water sits in a puddle on the deckplate it creates a bridge between the electrical connectors of one or several mating connections. The signal voltage for the connected devices (typically 3.3 VDC or 5 VDC) creates a potential difference between said electrical contacts. That potential difference creates an electrolytic current through the slightly conductive water bridge between said electrical connectors. This electrolysis leads to faster corrosion of the electrical contacts. Therefore the traditional deck plates need high maintenance in cleaning and frequent replacement.

Frequent cleaning of the electrical contacts to maintain clean, well conducting surfaces usually makes the long term effect of corrosion worse by abrading protective layers of the electrical contacts.

An adverse electrical effect of pool water sitting on the deckplate and bridging electrical contacts of mating connections is that the added conductance of the water bridge reduces the signal to noise ratio of the timing signals.

Another adverse electrical effect of corrosion is that the serial resistance of the corroded electrical contacts in the signal path adds to the reduction of the signal to noise ratio. In many cases of strong corrosion the signal becomes unreadable by the timer and the connection is therefore useless, demanding immediate intervention of cleaning or replacement.

In summary, aggressive pool water itself and electrolysis through aggressive pool water bridging contacts together with signal voltages results in corrosion of pool deck connections and thus signal degradation, which the current invention targets to improve.

BRIEF SUMMARY OF THE INVENTION

In order to break the pool water bridge between electrical contacts of mating connections the current invention places said contacts of the horizontally-mounted deckplate on an integrated slope steep enough to let the corrosive water flow off through gravity, overcoming the surface tension of the water. Once the water bridge is broken, even when water pearls are still sitting around the electrical contacts, the conductance for the electrolytic current between corresponding contacts is greatly reduced thus reducing electrolysis and corrosion.

Thus electrolysis can only take place in the short instances of water directly splashed on a mating connection by creating a water bridge between corresponding electrical contacts and the time it takes for said water bridge to flow off and break.

In order for the corrosive water to flow off, the surface tension of said water needs to be overcome. That calls for a gap of 4-5 mm between the surfaces of the deck plate and an inserted plug. In addition the slope needs to be steep enough to sufficiently break a standing water bridge. A standing water bridge typically has a height of around 3 mm.

A deck plate typically has more than one mating connection. The integrated slopes of all mating connections combined result in the overall shape of the deck plate. Depending on the embodiment this can result in a partially sloped design or a domed design should the mating connections be arranged in a semi-circular pattern.

To reduce corrosion effects through abrasion of protective surfaces it is beneficial to first select a material which is corrosion resistant in a swimming pool environment and then manufacture the connectors out of solid said material without plating. One of the materials that holds up well in a corrosive environment is titanium. One embodiment of the described deckplate is with titanium connectors.

DETAILED DESCRIPTION OF THE INVENTION

Figure 1:
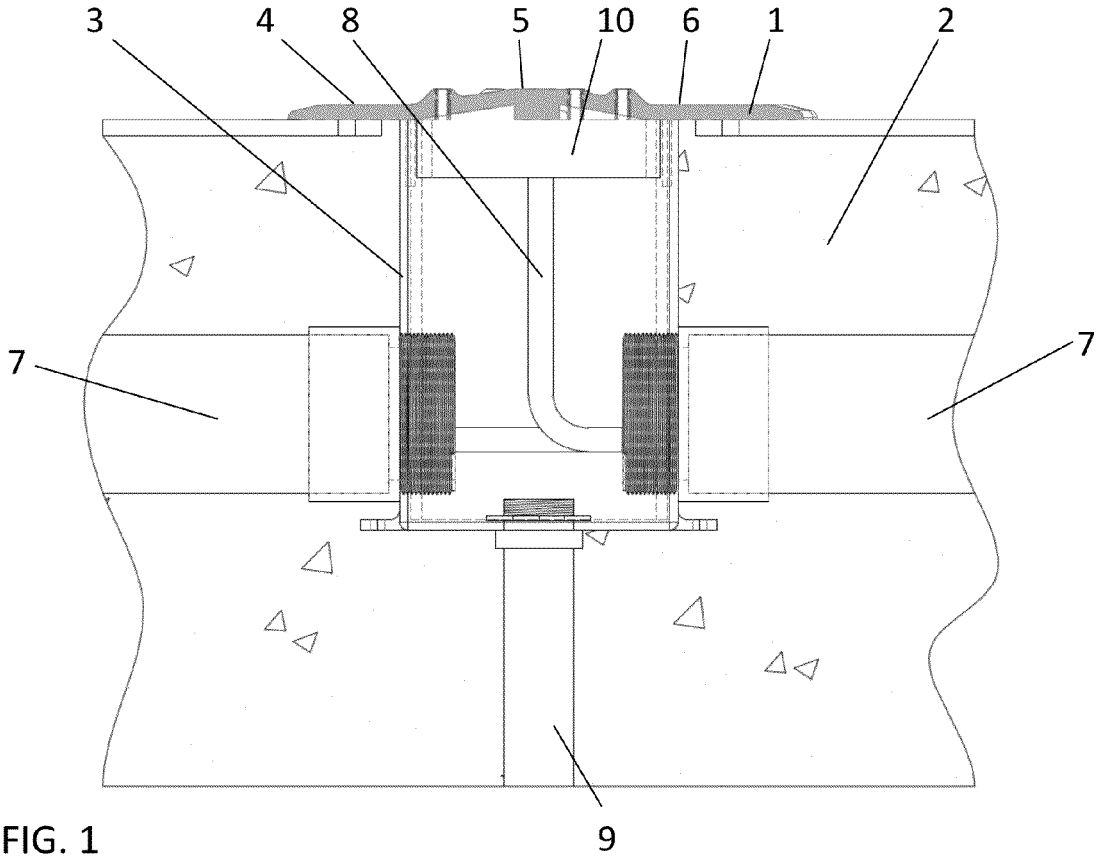
FIG. 1 is a section view of a horizontally-mounted deckplate in a pool deck or bulk head in a housing connector box, showing conduit, cable and drain.

A preferred embodiment of a deckplate is given in FIG. 1. The deckplate 1 is mounted in a connector box 3 in the pool deck or bulkhead 2, resulting in the deck plate being flush with the pool deck and the overall body of the deckplate being horizontal (horizontal surfaces 4, 5 and 6). In the connector box 3 conduit 7 is leading the cable 8 from the deckplate to connect to the timing system. In the bottom of the connector box 3 typically a drain 9 is installed to drain pool water coming from the pool deck.

On the underside of the deckplate is typically a compartment 10 situated around the electric connectors. Once the connection wires are affixed to the connectors in the manufacturing process, the deckplate is turned upside down and this compartment is filled with potting material to seal off the electric connections from the environment.

Typically during races touchpads, pushbuttons, speakers etc. are connected via plugs (see 11 in FIG. 2A) that are plugged into the deck plate to connect to the timing system. In this example banana plugs and jacks are shown to create mating connections.

When the deck plate is not in use and no connectors are plugged in on the top, which is the majority of the time, it is designed to be stepped on and rolled over with light equipment.

Figure 2A:
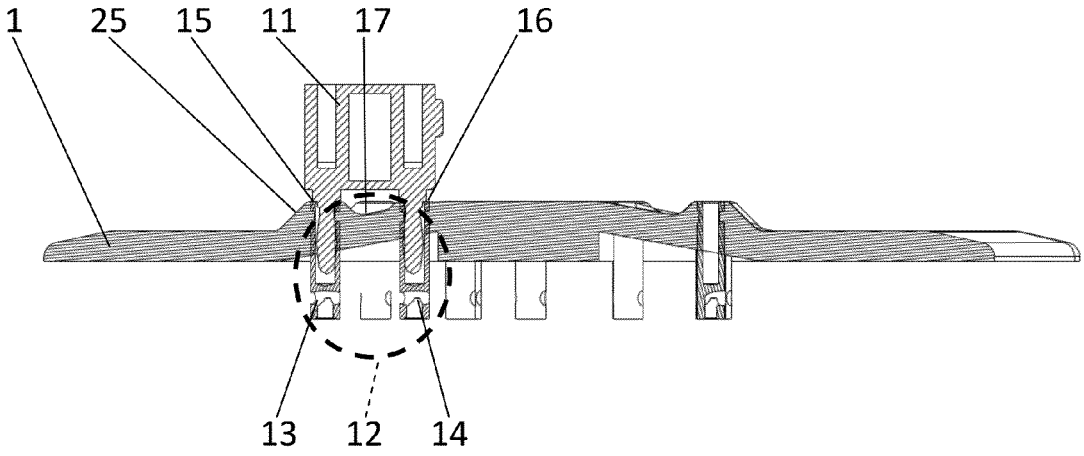
FIG. 2A is a section view of the deck plate itself showing the electrical connectors, slope area and a sectioned mating connection.

In FIG. 2A the main elements of a horizontal deckplate 1 with integrated slopes are shown. A mating connection 12 to a connector 11 consists of two or more electrical contacts (here two are shown 13, 14), which are embedded into the body of the deckplate 1. This mating connection 12 has a potential difference between its electrical contacts 13 and 14 due to the signal voltage. The electrical contact pair 13, 14 has the tops 15, 16 of said electrical contacts on the same horizontal plane. Between these electrical contacts is the integrated slope 17 to let the water flow off.

Figure 3A:
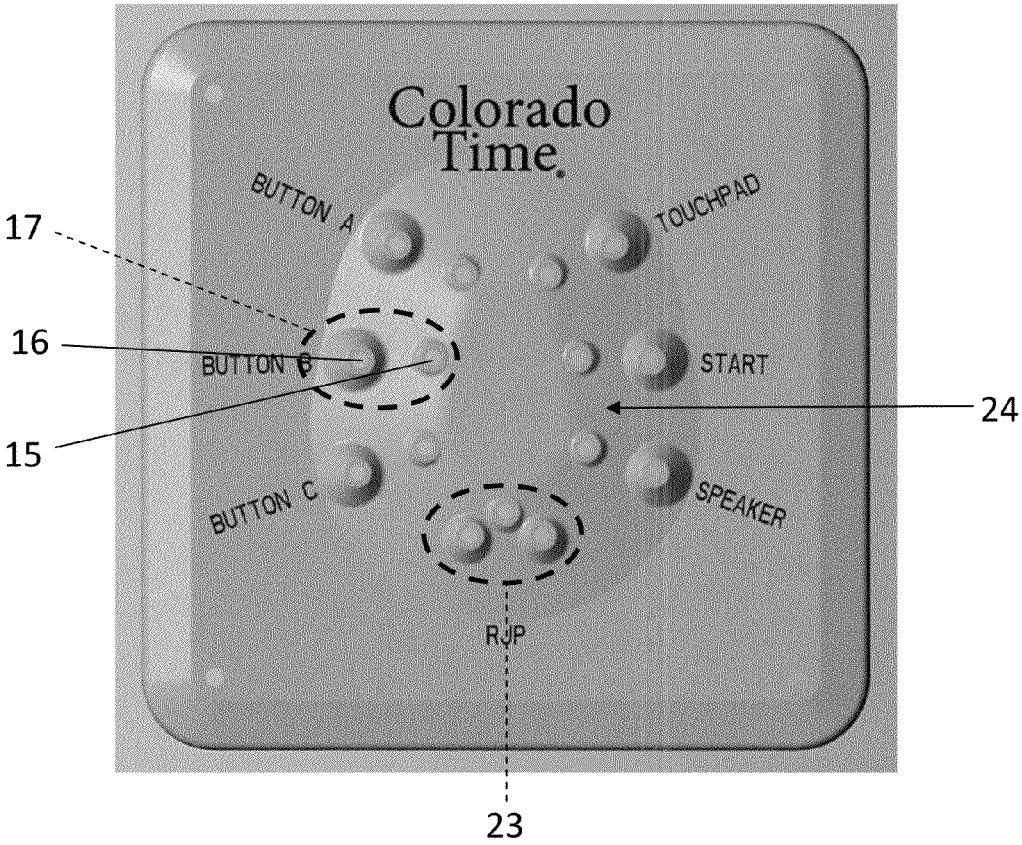
FIG. 3A is a top view of the horizontal deckplate.

In the top view of the deckplate of FIG. 3A the integrated slope 17 is the area around the tops of the electrical contacts 15 and 16.

Figure 2B:
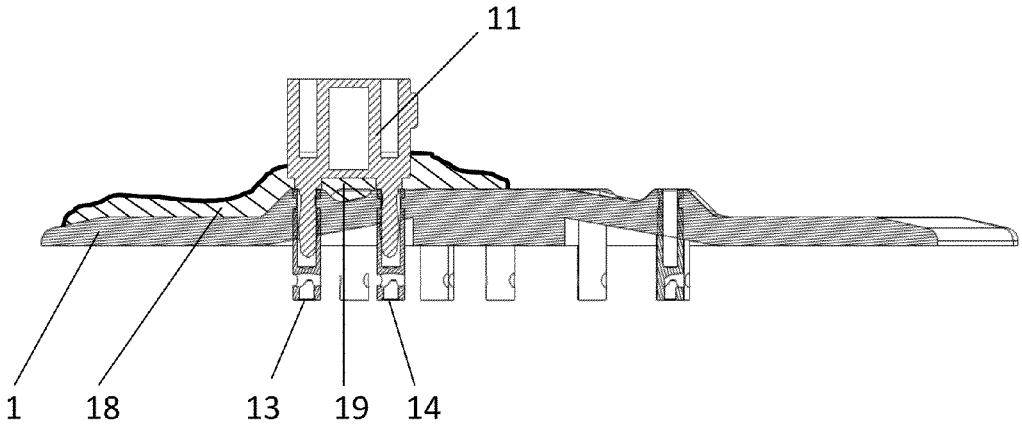
FIG. 2B shows a section view of the deckplate when water is splashed on a mating connection and forms a connecting bridge.
Figure 2C:
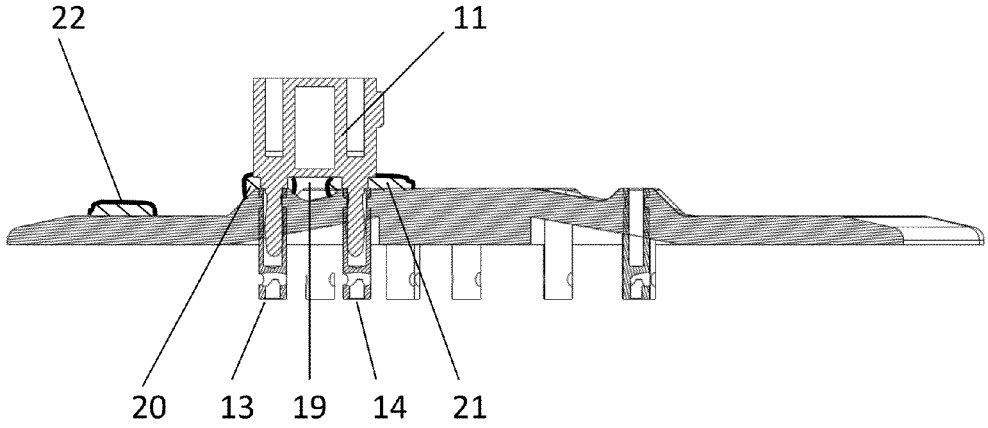
FIG. 2C shows a section view of the deckplate when the connecting bridge on the mating connection has flowed off.

FIGS. 2B and 2C show the function of the horizontal deckplate 1 with integrated slopes. Water 18 that is splashed in FIG. 2B on the deckplate 1 in the area of connector 11 and its electrical contacts 13, 14, flows around and bridges between the electrical contacts 13, 14 in the area 19. This causes the electrolytic current between the electrical contacts 13 and 14 to flow.

As soon as the water has flowed off and ended the bridge in area 19 the situation changes as shown in FIG. 2C. Only water droplets 20 and 21 are left around the electrical contacts 13, 14 and for example droplet 22 on the horizontal part of the deckplate, leaving the water bridge in area 19 broken. The electrolytic current between electrical contacts 13, 14 through area 19 encounters a vastly decreased conductance and is thus vastly reduced, reducing the corrosion of the electrical contacts of connector 11 and mating connection 12.

Mating connections can have two or more electrical contacts. In FIG. 3A the two electrical contacts 15 and 16 form a mating connection. Mating connection 23 has three electrical contacts. Electrical contacts of separate mating connections can be galvanically connected, for example when their electrical ground is connected.

Each integrated slope can be arranged in a manner that corrosive water can flow off in order to break the water bridge between any electrical contacts which have a potential difference and thus reduce an electrolytic current flow between them.

Figure 3B:
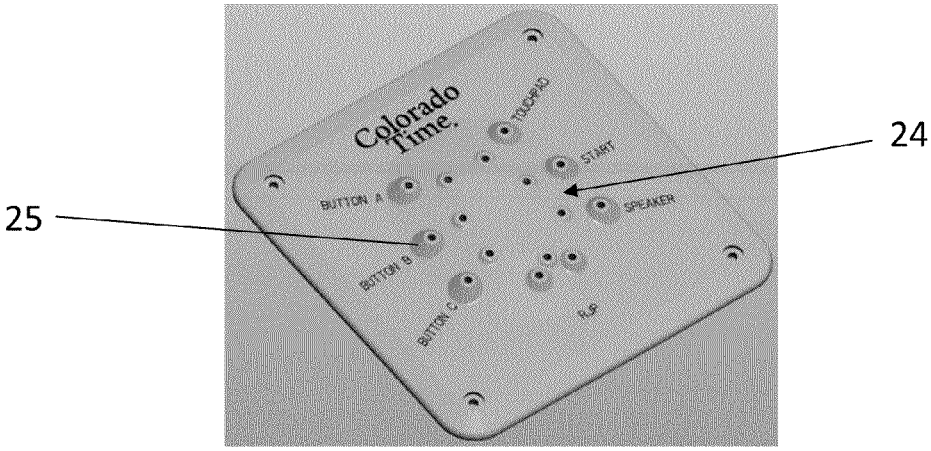
FIG. 3B is a perspective view of the horizontal deckplate.

Integrated slope areas such as 17 between mating connections define the overall shape of a deckplate, when more than one mating connections are arranged in said deckplate. In the views of FIGS. 3A and 3B of shown embodiment the result of the arrangement process of the semi-circular pattern of the mating connections is a dome 24, which creates the integrated slopes for all mating connections. In the case that the mating connections are not arranged in a semi-circular fashion it would be the corresponding integrated slope profile.

The slopes around the connectors themselves form embossments (for example embossment 25) up to the ends 15, 16 of the electric connectors on the horizontal plane. These embossments serve the purpose of creating a relatively smooth surface which can be walked on as well as deflecting any horizontal forces on the electric connectors upwards away from the electric connectors, such as from toys being thrown on the pool deck or cleaning machines. This enhances the robustness and longevity of the deck plate.

The embodiments so far described assume that the tops of the electric connectors of a given mating connection are on the same horizontal plane. The tops of the electric connectors can be on different horizontal planes and also the axis of the electric connectors can be tilted so that the tops of the electric connectors are in the same plane as the integrated slope or in its proximity. In any case the design has to let the water bridge between electric connectors flow off to break the bridge and reduce electrolysis.

The electric connectors, for example 13 and 14 of mating connections, are exposed to the aggressive chemicals of the pool environment. The exposition is from being splashed on and from being exposed to chemicals in the air.

Many customary electric connectors are comprised of a carrier material such as brass and various protective platings such as nickel. In the course of corrosion and subsequent frequent cleaning the protective layers are mechanically and chemically abraded and the carrier material is exposed. Cleaning solvents as well as pool water, intensified through electrolysis, and airborne corrosive chemicals can accelerate the corrosive processes of the carrier material and thus the electric connector as a whole.

Therefore a material which is corrosion resistant in pool environment and not comprised of carrier material and protective layers is preferable for the electric connectors. The preferred embodiment of the current invention uses titanium as a possible electric connector material. Titanium is known to be extremely resistant to chlorine and other chemicals found in pool environments, carried through the water or the air.

The disclosed embodiments are representative of presently preferred forms of the invention, but are intended to be illustrative rather than definitive of the invention.

The invention claimed is:

1. Connector deck plate with electrical contacts for use in wet and corrosive environments such as swimming pool decks or bulkheads comprised of a body which is mounted on an essentially horizontal plane;

two or more electrical contacts of at least one mating connection;

a substantial slope relative to the horizontal plane between said electrical contacts;

said integrated slope steep enough so that liquid splashed on the electrical contacts forming a connective bridge between said electrical contacts flows off through gravity, overcoming the surface tension of the liquid, thus breaking said connective bridge;

said slope integrated into the body of the deck plate.

2. Deckplate according to claim 1 where said electrical contacts of said at least one mating connection are mounted so that the tops of said electrical contacts are on the same plane and said plane of the tops of said electrical contacts is essentially horizontal.

3. Deckplate according to claim 1 or 2 with a surface connecting at least two individual integrated slopes between at least two mating connections, thereby defining the overall profile of integrated slopes of said deckplate.

4. Deckplate according to claim 3 with a surface connecting the integrated slopes of at least two mating connections going around the deckplate in a semi-circular fashion to create a domed structure on which the contacts are arranged in a semi-circular pattern.

5. Deckplate according to claim 1 or 2 with a surface connecting to the integrated slope of one mating connection going around the deckplate in a semi-circular fashion to create a domed structure.

6. Deckplate according to claim 1 or 2 extending the integrated slope of a single mating connection beyond the area of said mating connection, thereby defining the overall profile of the deckplate.

7. Deckplate according to claim 1 or 2 with electrical contacts made of titanium.

* * * * *

UNITED STATES PATENT AND TRADEMARK OFFICE

CERTIFICATE OF CORRECTION

PATENT NO. : 8,602,815 B2
APPLICATION NO. : 13/225654
DATED : December 10, 2013
INVENTOR(S) : Stockinger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 310 days.

Signed and Sealed this
Twenty-third Day of May, 2017

Michelle K. Lee

Michelle K. Lee
*Director of the United States Patent and Trademark Office*